US011203874B2

(12) United States Patent
Karras

(10) Patent No.: US 11,203,874 B2
(45) Date of Patent: Dec. 21, 2021

(54) GLASS WINDBREAKER

(71) Applicant: ALUMINCO A.E., Viotias (GR)

(72) Inventor: Anargiros Karras, Viotias (GR)

( * ) Notice: Subject to any disclaimer, the term of this patent is extended or adjusted under 35 U.S.C. 154(b) by 720 days.

(21) Appl. No.: 15/765,930

(22) PCT Filed: Aug. 10, 2016

(86) PCT No.: PCT/GR2016/000038
§ 371 (c)(1),
(2) Date: Apr. 4, 2018

(87) PCT Pub. No.: WO2017/060742
PCT Pub. Date: Apr. 13, 2017

(65) Prior Publication Data

US 2019/0112817 A1 Apr. 18, 2019

(30) Foreign Application Priority Data

Oct. 9, 2015 (GR) ..... 20150100437

(51) Int. Cl.
*E04H 17/16* (2006.01)
*E04F 11/18* (2006.01)

(52) U.S. Cl.
CPC ..... *E04F 11/1853* (2013.01); *E04F 11/1865* (2013.01); *E04H 17/16* (2013.01)

(58) Field of Classification Search
CPC . E04F 11/181; E04F 11/1851; E04F 11/1861; E04F 11/1865; E04F 11/1853; E01F 13/048; E04H 17/16; E04B 2/7424; E04B 2/745
See application file for complete search history.

(56) References Cited

U.S. PATENT DOCUMENTS 8,919,740 B2 * 12/2014 Carlsson ..... E04F 11/1851 256/24

FOREIGN PATENT DOCUMENTS

| | | | | |
|---|---|---|---|---|
| EP | 2 728 080 | * | 5/2014 | ..... E04B 2/74 |
| EP | 2 775 057 | * | 9/2014 | ..... E04F 11/18 |
| EP | 2 395 167 | * | 7/2015 | ..... E04B 2/74 |
| WO | WO 2011/027377 | * | 3/2011 | ..... E06B 3/92 |

* cited by examiner

*Primary Examiner* — Michael P Ferguson

(57) ABSTRACT

A glass windbreaker has a mobile portion and a fixed portion. The mobile portion includes a glass pane secured between two inner vertical profiles, each of the inner vertical profiles having a rod extending within the vertical profile and matching components secured about the rod. The fixed portion includes a second glass pane secured between two outer vertical profiles. Each of the inner vertical profiles are extendable from within a corresponding outer vertical profile, and the glass pane is vertically movable relative to the second glass pane. A locking mechanism, which includes the components secured about each rod, secures the mobile portion in a closed position relative to the fixed portion.

8 Claims, 8 Drawing Sheets

GLASS WINDBREAKER

CROSS-REFERENCE TO RELATED APPLICATIONS

This application is National Stage entry from International Application no. PCT/GR2016/000038, filed on Aug. 10, 2016, which claimed priority to Greek patent application no. 20150100437, filed on Oct. 9, 2015.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

INCORPORATION-BY-REFERENCE OF MATERIAL SUBMITTED VIA EFS-WEB

Not applicable.

STATEMENT REGARDING PRIOR DISCLOSURES BY THE INVENTOR OR A JOINT INVENTOR

Not applicable.

BACKGROUND OF THE INVENTION

Field of the Invention

The invention refers to a glass windbreaker, which consists of two parts, a stable part and a mobile part, and which have security panes secured with aluminum profiles on a right and on a left vertical sides. The mobile part of the glass windbreaker can move (up-down) inside of the stable part with gas pistons, which are located in its inner part, and can provide protection from the wind if needed.

Description of Related Art

Windbreakers of that type consisting of two glass windbreakers, from which the one has the ability to be lifted in order to maximize its height, are well known. They have aluminum or iron profile frame and they are divided into mechanical and manual, depending on the way they lift and lock their mobile pane. The mechanical movement of the windbreaker is accomplished with the use of a motor, which is located into the frame of the pane and which along with the help of pulleys moves the pane upwards. This solution demands a higher cost of purchase because of the motor, the pulleys, the electrical installation and the specialized staff needed for the installment and maintenance. The second solution of the manual lifted windbreaker is difficult to use and not practical because the upwards movement of the pane requires muscular power by the user and the lock of the pane in the higher position is made by the user with a metallic pin.

BRIEF SUMMARY OF THE INVENTION

The advantage of the present invention is that the glass windbreaker consists of two parts, the stable and the mobile, the glass surface of which parts has only vertical aluminum profiles offering unlimited view, movement (up-down) of the mobile part using a mechanism without any muscular power, but with the use of gas pistons and a mechanism of locking unlocking the piston's rod, which happens via a simple push of the mobile part downwards. The glass windbreaker has the characteristic that the movement of the pane is made with the use of two gas pistons and a mechanism of locking and unlocking, which allows the user to lift and drop the windbreaker easily and practically no matter the weight of the mobile pane.

BRIEF DESCRIPTION OF THE SEVERAL VIEWS OF THE DRAWINGS

The invention will be better understood with reference to the following figures.

DETAILED DESCRIPTION OF THE INVENTION

Figure 1:
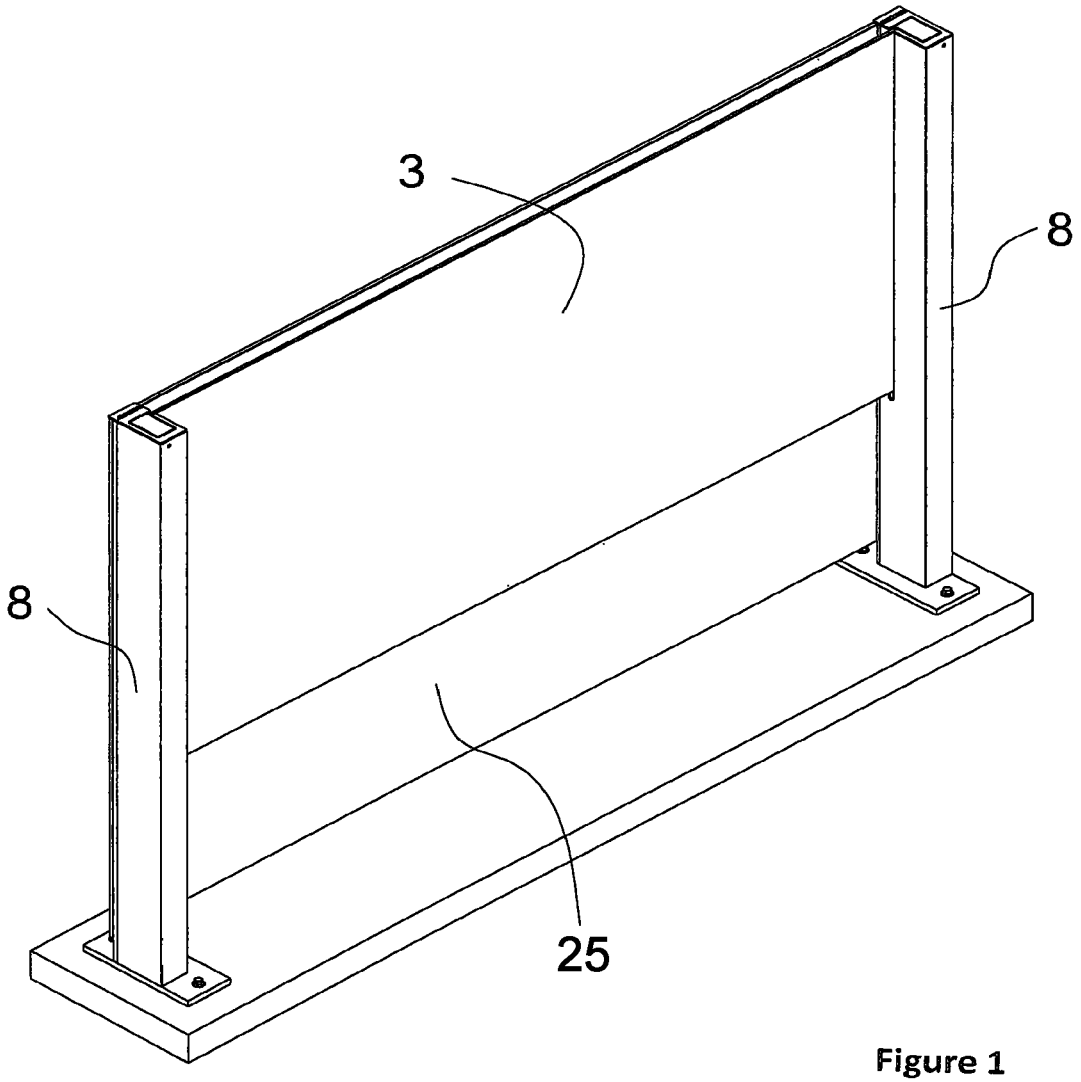
FIG. 1 shows a perspective view of the glass windbreaker in close position.

FIG. 1 shows a perspective view of the glass windbreaker in close position.

Figure 2:
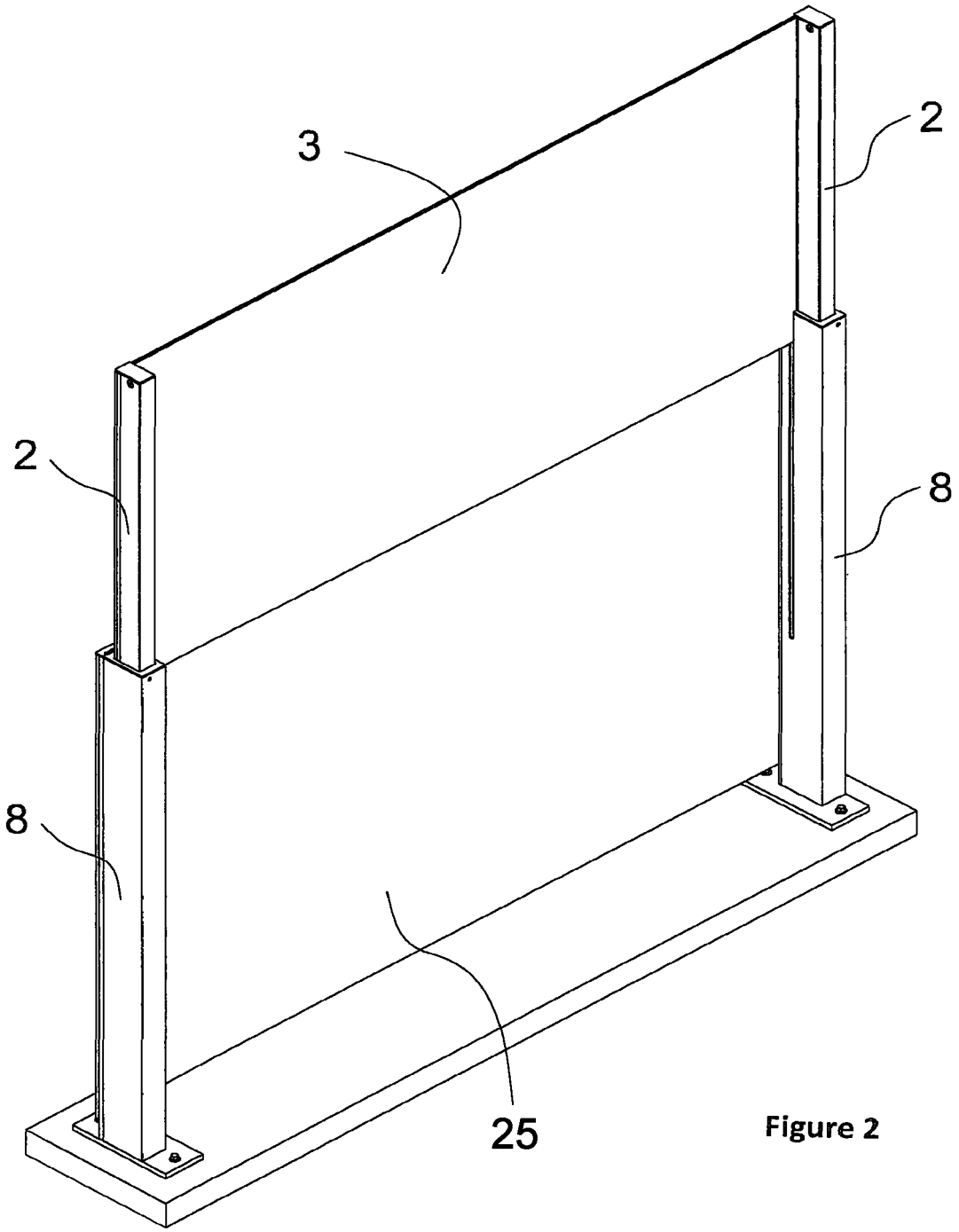
FIG. 2 shows a perspective view of the glass windbreaker in open position.

FIG. 2 shows a perspective view of the glass windbreaker in open position.

Figure 3:
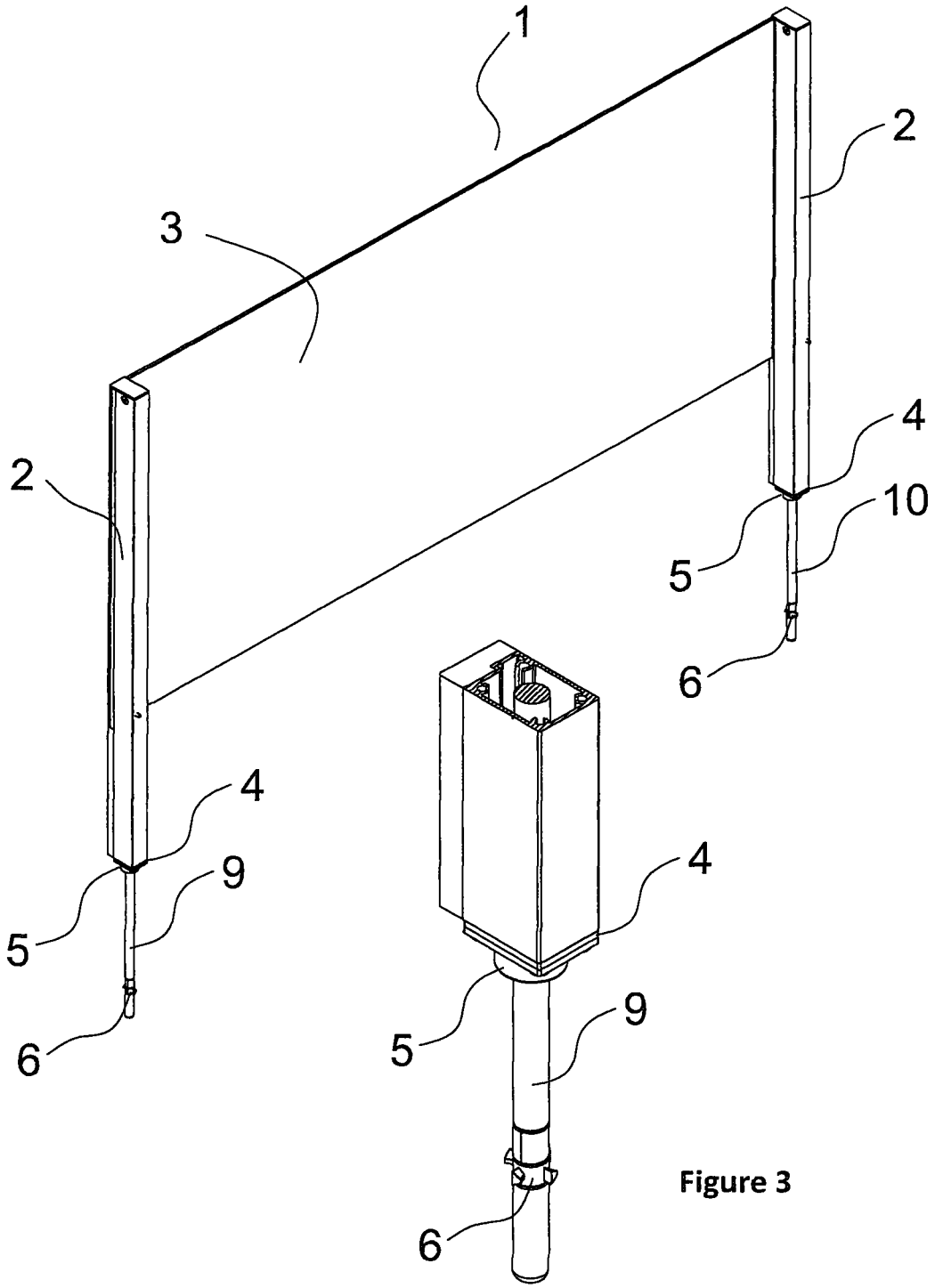
FIG. 3 shows a mobile part of the glass windbreaker.

FIG. 3 represents the mobile part (1) of the construction, which consists of a secure 6 millimeter (mm) glass pane (3), the sided aluminum profiles (2), right and left, the plastic accessories (4), (5), the rod (9) and the plastic pivot (6).

Figure 4:
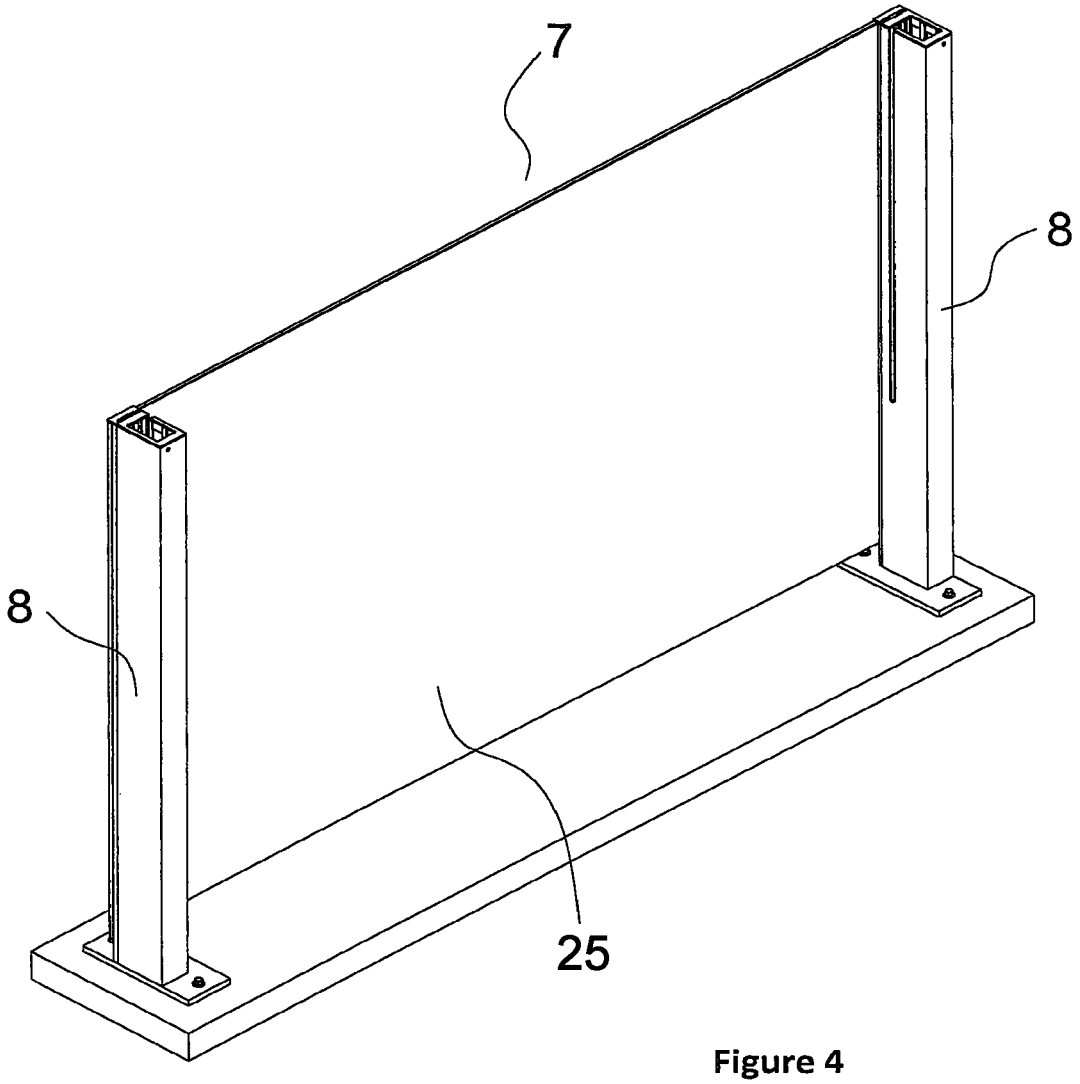
FIG. 4 shows a stable part of the glass windbreaker.

FIG. 4 represents the stable part (7) of the construction, which consists of an 8 mm security pane (25) and the sided aluminum profiles (8) right and left.

Figure 5:
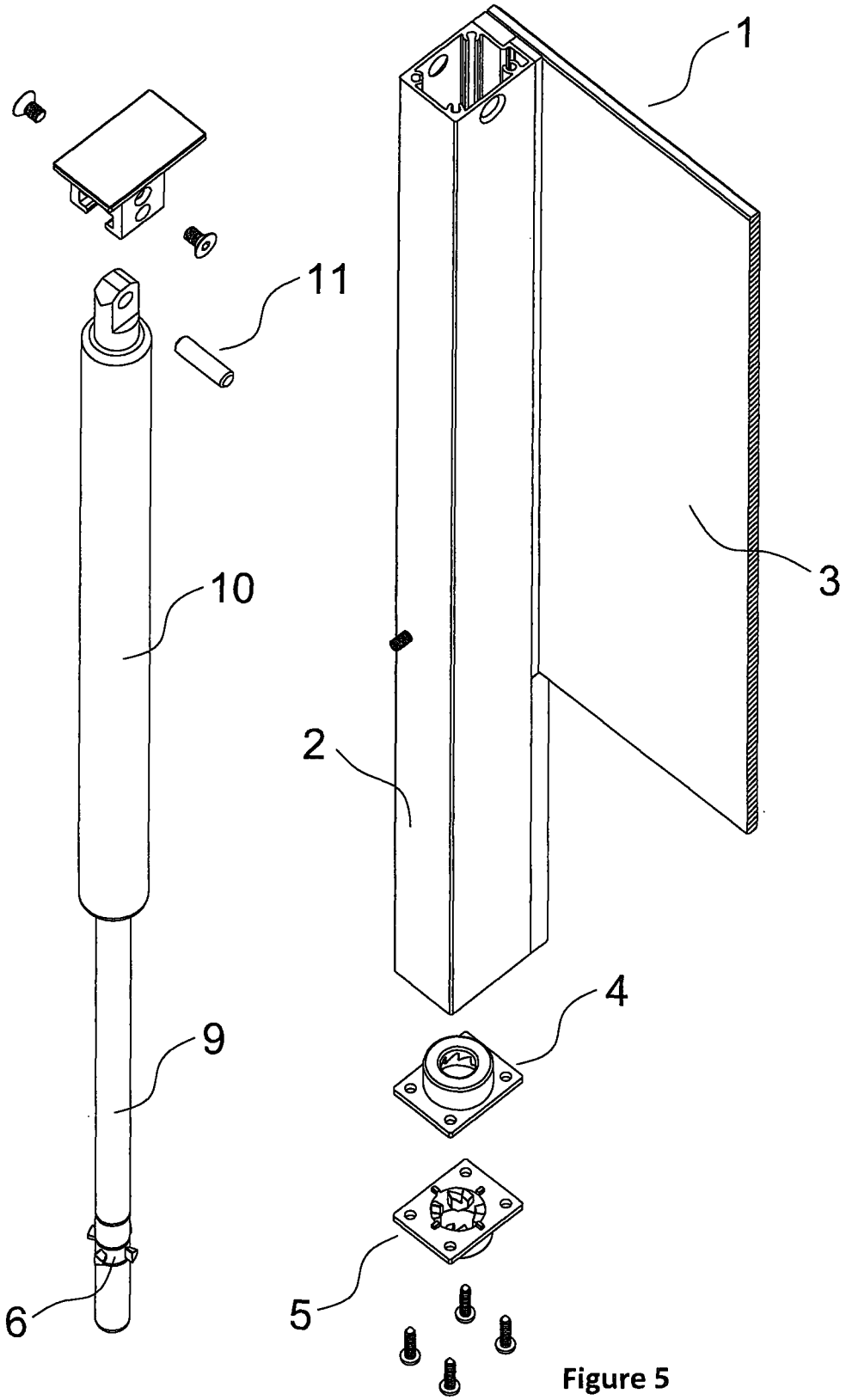
FIG. 5 is an exploded view along a portion of the mobile part.

FIG. 5 represents analytically the left side of the mobile part (1), which consists of the aluminum profile (2) with a rectangular form, inside of which common nitrogen piston (10) with rod (9) is placed facing upwards, mounted on the cap with the pin (11), located in the upper side of the aluminum profile (2), the plastic accessories (4) and (5) which are screwed to the bottom side of the aluminum profile (2) and the extra axis with the plastic pivot (6) in the ending edge of the rod (10) piston (9).

Figure 6:
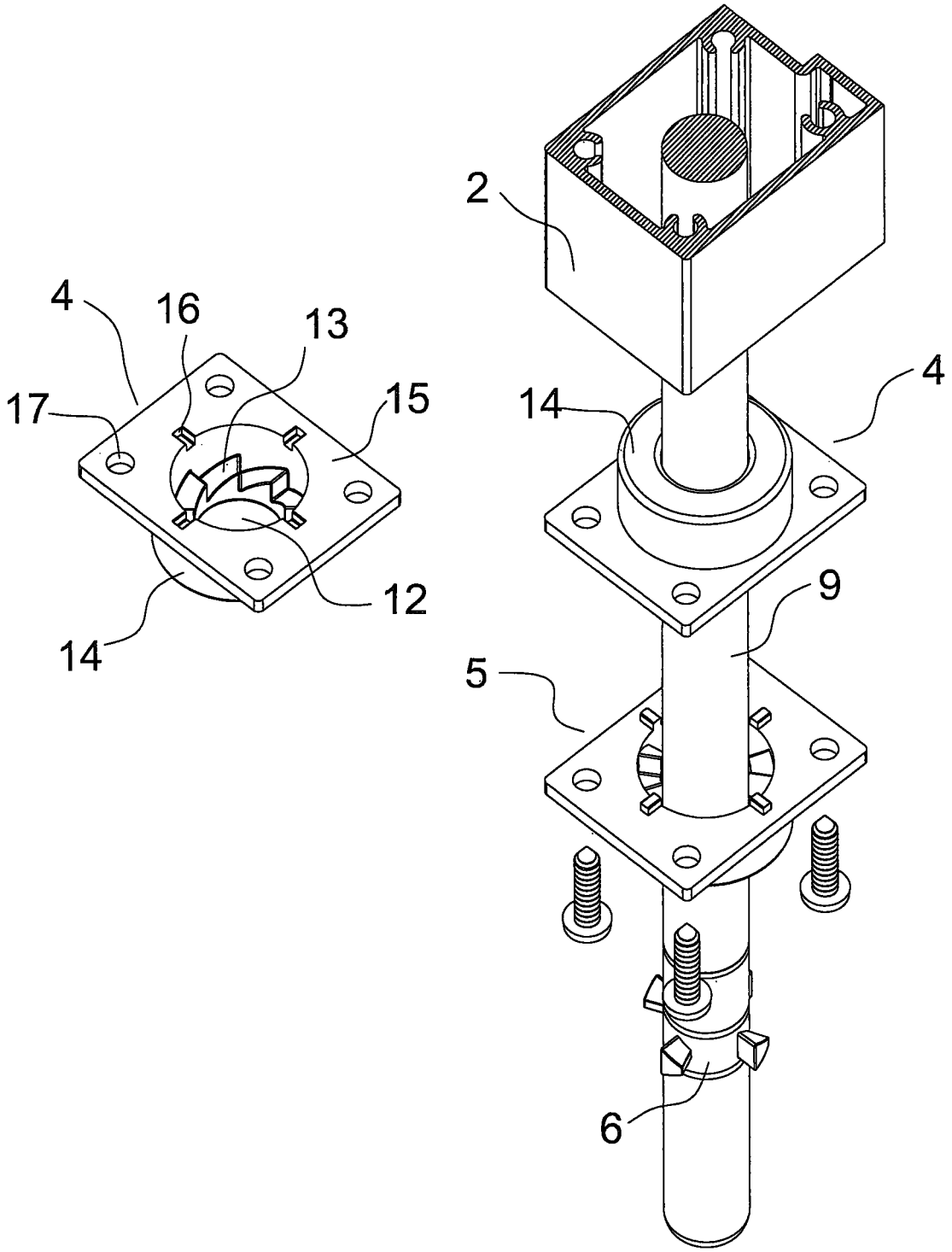
FIG. 6 is an exploded view of a plastic accessory and a plastic component about a rod of the mobile part.

FIG. 6 represents the plastic accessory (4), with an inside hole (12) to let the rod (9) pass through, a circular ring (14) inside which there is a peripheral toothing (13) of chestnut type with 4 teeth whose one side (26) is vertical and other side (27) forms an angle of 34 degrees with the plane of the plate (15) which has at the four corners holes (17) for screwing the aluminum profile (2) and 4 slots (16) peripheral hole cross-shaped to align with the plastic component (5).

Figure 7:
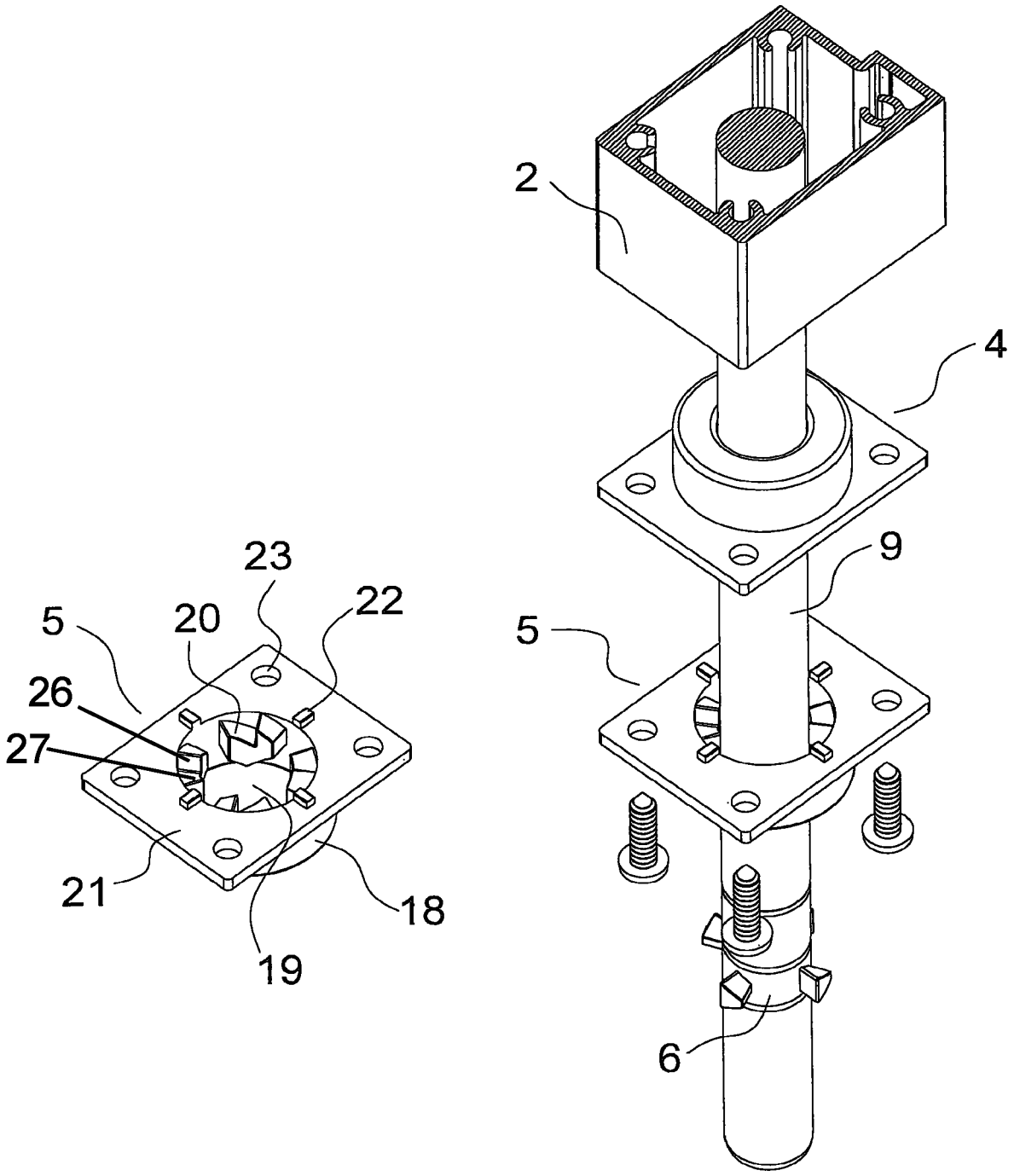
FIG. 7 is an exploded view of a plastic accessory and a plastic component about a rod of the mobile part.

In the FIG. 7 the plastic accessory is shown (5) with an inner hole (19) enabling the rod to pass through (9), circular ring (14) inside of which there is a peripheral toothing (20) with four teeth whose one side is vertical and other one forms an angle of 34 degrees with the plane of the plate (21) bearing on the corners holes (23) for screwing the aluminum profile (2) and cross-shaped projections (22) circumferentially of the bore for alignment with the grooves (16) of the plastic accessory (4). The four teeth (20) have between them four openings enabling the plastic pivot (6) to pass through and form externally angle enabling the plastic pivot to be always deflected and leading the pivot between the plastic accessories (4) and (5).

Figure 8:
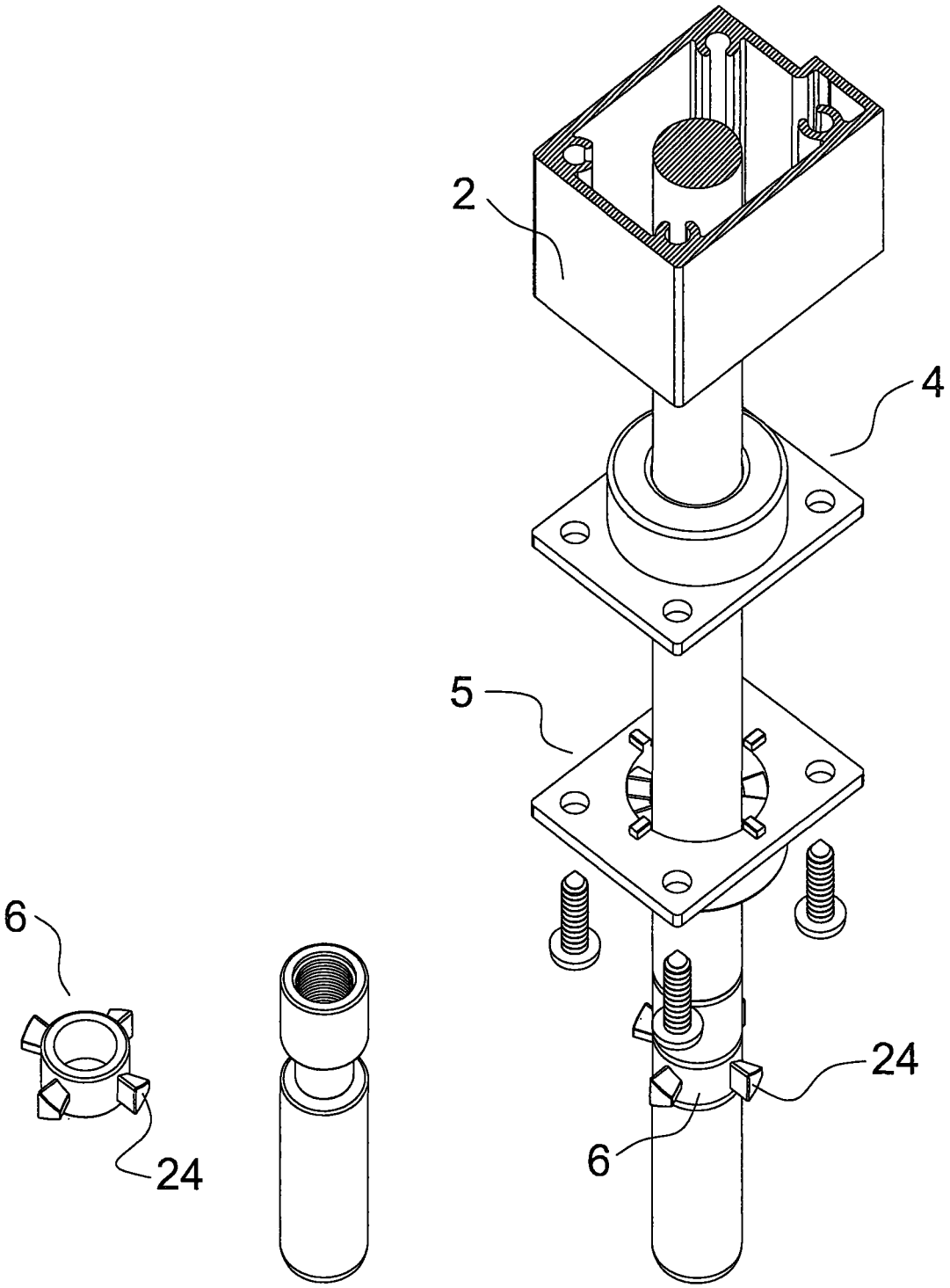
FIG. 8 shows a pivot of the mobile part.

FIG. 8 represents the plastic pivot (6) which is located in the lower end of the rod (9) and rotates freely to shoulder the extra axis, has four trapezoidal peripheral teeth (24) lined around in cross shape with gaps between them.

The glass windbreaker consisting of the mobile part (1) and the stable part (7) has in its inner part the profile (2) pistons (10) of nitrogen gas hanging upside down with their body up and the rod (9) hanging downwardly, plastic accessories (4) and (5) which consist the main accessory of locking unlocking the rod (9) of the piston (10), positioned at the bottom of the profile (2) with the accessory (4) applied first to the aluminum profile (2) and the accessory (5) applied on top to (4) aligned with the recesses (16) and the projections (22), wherein in combination with the extra axis carrying the plastic pivot (6) and rotates freely mounted on the end of the rod (9) allows the plastic pivot (6) to first pass from the openings between the teeth (20) of the accessory (5), to be inserted in the toothing (13) of the accessory (4) is deflected rotationally and during its return to be trapped inside the toothing (20) of the component (5) holding the rod (9) compressed within the body of the piston (10) causing the mobile part of the glass windbreaker to be in the close position.

With a simple pressing down of the mobile part (1) the plastic pivot (6) with the rod (9) is moving inside the accessories (4) and (5) to the toothing (14) where it is deflected rotationally enabling it to pass between the openings of the teeth (20) of the accessory (5) and be expanded form the body of the piston (10) causing the lifting of the mobile part (1) of the glass windbreaker.

The invention claimed is:

1. A glass windbreaker, comprising:

a stable part having:

a stable part glass pane, and two outer profile members vertically arranged along opposing ends of the stable part glass pane, and a mobile part having:

a mobile part glass pane, two inner profile members vertically arranged along opposing ends of the mobile part glass pane, wherein each inner profile member is insertable within a corresponding outer profile member of said two outer profile members, a rod downwardly extendable from a piston oriented within each of the two inner profile members, wherein each piston is secured to an upper end of a corresponding inner profile member of the two inner profile members by a cap and a pin, and wherein a lower free end of each rod is secured against a lower end of the corresponding outer profile member, a pivot member rotatably secured about the lower free end of each said rod, the pivot member having pivot member teeth, and a locking mechanism attached to each of the two inner profile members along a lower end of each said two inner profile members, each said locking mechanism having a top portion having a top portion hole and a top portion circular ring, and a bottom portion having a bottom portion hole and a bottom portion circular ring, the top portion and the bottom portion secured together, the rod extending through the locking mechanism via the top portion hole and the bottom portion hole, wherein, for each said locking mechanism, the top portion circular ring houses a top set of peripheral toothing and the bottom portion circular ring houses a bottom set of peripheral toothing, the top set of peripheral toothing and the bottom set of peripheral toothing oriented toward each other, the bottom set of peripheral toothing having openings therebetween to accommodate each tooth of the pivot member teeth, wherein the glass windbreaker is in an expanded form when the mobile part is pressed down causing, for each said pivot member, the top set of peripheral toothing to rotationally deflect the pivot member teeth out of teeth of the bottom set of peripheral toothing and out of the locking mechanism via the openings in the bottom set of peripheral toothing, thereby allowing each said rod to downwardly extend from a corresponding piston and against the lower end of the corresponding outer profile member, which moves the mobile part upward relative to the stable part, and wherein the glass windbreaker is in a closed form when the mobile part is pushed downwards such that, for each pivot member, the pivot member teeth enter the locking mechanism via the openings between the bottom set of peripheral toothing, the pivot member teeth are rotationally deflected by the top set of peripheral toothing, and the pivot member teeth are secured within the teeth of the bottom set of peripheral toothing.

2. The glass windbreaker of claim 1, wherein each said pivot member has four pivot member teeth.

3. The glass windbreaker of claim 2, wherein each of the four pivot member teeth of each said pivot member are trapezoidal.

4. The glass windbreaker of claim 2, wherein, for each said bottom portion, the teeth of the bottom set of peripheral toothing comprises four bottom portion teeth, each of the four bottom portion teeth having a vertical side adjacent to an angled side angled at 34 degrees relative to a bottom portion plate.

5. The glass windbreaker of claim 4, wherein, for each said locking mechanism, the top portion includes a top portion plate and the bottom portion includes the bottom portion plate.

6. The glass windbreaker of claim 5, wherein the top portion plate has a plurality of holes to accept fasteners, and the bottom portion plate has a plurality of holes to accept the fasteners, the fasteners securing both the top portion and the bottom portion to a corresponding inner profile member.

7. The glass windbreaker of claim 1, wherein each said pivot member freely rotates about a corresponding rod.

8. The glass windbreaker of claim 1, wherein each said locking mechanism is secured around a corresponding rod between the corresponding piston and a corresponding pivot member.

* * * * *